US009064467B2

(12) United States Patent
Im et al.

(10) Patent No.: US 9,064,467 B2
(45) Date of Patent: Jun. 23, 2015

(54) LIQUID CRYSTAL DISPLAY DEVICE AND DRIVING METHOD THEREOF

(71) Applicant: Samsung Display Co., Ltd., Yongin, Gyeonggi-Do (KR)

(72) Inventors: Chang-Jin Im, Yongin (KR); Dong-Wan Choi, Yongin (KR); Hee-Kwon Eun, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 15 days.

(21) Appl. No.: 13/973,869

(22) Filed: Aug. 22, 2013

(65) Prior Publication Data

US 2014/0118325 A1 May 1, 2014

(30) Foreign Application Priority Data

Oct. 29, 2012 (KR) ..... 10-2012-0120645

(51) Int. Cl.
*G09G 3/36* (2006.01)

(52) U.S. Cl.
CPC ..... *G09G 3/3614* (2013.01); *G09G 3/3648* (2013.01); *G09G 2320/0204* (2013.01)

(58) Field of Classification Search
CPC . G09G 3/3696; G09G 3/3659; G09G 3/3644; G09G 3/3614; G09G 3/3648
See application file for complete search history.

(56) References Cited

U.S. PATENT DOCUMENTS

| | | | | |
|---|---|---|---|---|
| 6,552,707 | B1 | 4/2003 | Fujiyoshi | |
| 2011/0181583 | A1* | 7/2011 | Kim et al. | 345/212 |
| 2012/0162183 | A1 | 6/2012 | Kwon et al. | |
| 2012/0176351 | A1* | 7/2012 | Hsieh et al. | 345/204 |

FOREIGN PATENT DOCUMENTS

| | | |
|---|---|---|
| KR | 10-2007-0079103 | 8/2007 |
| KR | 10-2012-0075166 | 7/2012 |
| KR | 10-2012-0077562 | 7/2012 |

* cited by examiner

*Primary Examiner* — Latanya Bibbins
(74) *Attorney, Agent, or Firm* — Robert E. Bushnell, Esq.

(57) ABSTRACT

There are provided a liquid crystal display device and a driving method thereof, which can reduce power consumption and improve image quality. A liquid crystal display device includes pixels, a data driver and at least one gate driver. The pixels are positioned at intersection portions of gate lines and data lines. The data driver supplies a data signal having a first or second polarity to the data lines. The at least one gate driver supplies, to the gate lines, a first gate signal corresponding to the first polarity and a second gate signal corresponding to the second polarity.

11 Claims, 5 Drawing Sheets

LIQUID CRYSTAL DISPLAY DEVICE AND DRIVING METHOD THEREOF

CLAIM OF PRIORITY

This application makes reference to, incorporates the same herein, and claims all benefits accruing under 35 U.S.C. §119 from an application earlier filed in the Korean Intellectual Property Office on 29 Oct. 2012 and there duly assigned Serial No. 10-2012-0120645.

BACKGROUND OF THE INVENTION

1. Field of the Invention

An aspect of the present invention relates to a liquid crystal display device and a driving method thereof, and more particularly, to a liquid crystal display device and a driving method thereof, which can reduce power consumption and improve quality of images displayed.

2. Description of the Related Art

With the development of information technologies, the importance of display devices has come into the spotlight as connection media between users and information. Accordingly, the use of flat panel display devices (FPDs) is increased, such as liquid crystal display devices (LCDs), organic light emitting display devices (OLEDs) and plasma display panels (PDPs).

Among these FPDs, the LCDs can implement high resolution and have not only a smaller size but also a larger size. Thus, the LCDs are widely used.

An LCD displays an image using electro-optical characteristics of liquid crystals. To this end, the LCD may include a color filter substrate and a thin film transistor (TFT) substrate, which are disposed opposite to each other with the liquid crystals interposed therebetween.

The color filter substrate implements colors of an image displayed through the LCD. To this end, the color filter substrate may include a black matrix and a color filter.

The TFT substrate applies the voltage of a data signal for driving the liquid crystals. To this end, the TFT substrate may include gate lines, data lines, TFTs and pixel electrodes. The TFT substrate may further include a common electrode. Here, the common electrode may be formed on the color filter substrate, corresponding to a liquid crystal driving method.

The LCD described above supplies the voltage of a data signal to the pixel electrode using the TFT included in each pixel. In this case, the liquid crystals are driven by the difference in voltage between the pixel and common electrodes, thereby displaying a predetermined image. Meanwhile, in a case where DC voltage having the same polarity is applied to the liquid crystals for a long period of time, deterioration of the liquid crystal occurs.

In order to prevent the deterioration of the liquid crystals, there is used a polarity inversion driving method in which the voltage of a data signal applied to the liquid crystals is periodically changed. The polarity inversion driving method is divided into a frame inversion driving method, a line inversion driving method, a column inversion driving method, a dot inversion driving method, etc.

Among these inversion driving methods, in the dot inversion driving method, a data signal having a polarity opposite to that of all pixels horizontally and vertically adjacent to each pixel is supplied to the pixel, and the polarity of the data signal is inverted in every frame. In the dot inversion driving method, flickers occurring between vertically and horizontally adjacent pixels are offset to each other. Thus, the dot inversion driving method provides images with image quality superior to the other inversion driving methods.

Meanwhile, in a case where polarity of a data signal is periodically changed, the voltage of a gate signal is determined in consideration of both positive and negative data signals. In other words, a gate-on voltage Von is set so that the TFT can be turned on by the voltage of the positive (+) data signal, and a gate-off voltage Voff is set so that the TFT can be turned off by the voltage of the negative (−) data signal.

In this case, the gate-off voltage Voff significantly lower than that of the positive (+) data signal is applied, and the gate-on voltage Von significantly higher than that of the negative (−) data signal is applied. Therefore, power consumption is increased.

In a case where the voltage difference between the gate-on voltage Von and the gate-off voltage Voff is large, a kick-back voltage is generated, and therefore, the image quality is degraded.

The above information disclosed in this Background section is only for enhancement of understanding of the background of the described technology and therefore it may contain information that does not form the prior art that is already known in this country to a person of ordinary skill in the art.

SUMMARY OF THE INVENTION

Embodiments of the present invention provide a liquid crystal display device and a driving method thereof, which can reduce power consumption and improve image quality.

In accordance with an aspect of the present invention, a liquid crystal display device may include pixels positioned at intersection portions of gate lines and data lines; a data driver that supplies a data signal having a first or second polarity to the data lines; and at least one gate driver that supplies, to the gate lines, a first gate signal corresponding to the first polarity and a second gate signal corresponding to the second polarity.

The first and second gate signals may be set to gate-on and gate-off voltages different from each other. The first polarity may be set to be negative and the second polarity may be set to be positive. The first gate signal may be set to a first gate-on voltage and a first gate-off voltage, and the second gate signal may be set to a second gate-on voltage higher than the first gate-on voltage and a second gate-off voltage higher than the first gate-off voltage. A second voltage difference between the first gate-on voltage and the first gate-off voltage may be set identical to a first voltage difference between the second gate-on voltage and the second gate-off voltage.

An i-th (i is an odd number) gate line positioned on an i-th horizontal line may be coupled to pixels positioned on an i-th vertical line, and an (i+1)-th (i+1 is an even number) gate line positioned on the i-th horizontal line may be coupled to pixels positioned on an (i+1)-th vertical line. An i-th gate line positioned on an (i+1)-th horizontal line may be coupled to pixels positioned on an (i+1)-th vertical line, and an (i+1)-th gate line positioned on the (i+1)-th horizontal line may be coupled to pixels positioned on an i-th vertical line. The i-th gate line and the (i+1)-th gate line may be driven by one gate driver. The i-th gate line may be driven by a first gate driver, and the (i+1)-th gate line may be driven by a second driver. Each data line may be coupled to two adjacent pixels every horizontal line.

In accordance with an aspect of the present invention, a driving method of a liquid crystal display device, includes steps of: supplying a first gate signal to odd-numbered gate lines, corresponding to a data signal having a first polarity, during a k-th (k is a natural number) frame period; and supplying a second gate signal set to a voltage different from the first gate signal to even-numbered gate lines, corresponding to a data signal having a second polarity, during the k-th frame period.

The second gate signal may be supplied to the odd-numbered gate lines, corresponding to the data signal having the second polarity, during a (k+1)-th frame period, and the first gate signal may be supplied to the even-numbered gate lines, corresponding to the data signal having the first polarity, during the (k+1)-th frame period. The first polarity may be set to be negative and the second polarity may be set to be positive. The first gate signal may be set to a first gate-on voltage and a first gate-off voltage, and the second gate signal may be set to a second gate-on voltage higher than the first gate-on voltage and a second gate-off voltage higher than the first gate-off voltage. A second voltage difference between the first gate-on voltage and the first gate-off voltage may be set identical to a first voltage difference between the second gate-on voltage and the second gate-off voltage.

In the liquid crystal display device and the driving method thereof according to the present invention, a first gate signal is supplied corresponding to a negative data signal, and a second gate signal is supplied corresponding to a positive data signal. Here, the first and second gate signals are set to a gate-on voltage and a gate-off voltage, corresponding to the positive and negative data signals, respectively. Accordingly, it is possible to minimize power consumption.

Further, the first and second gate signals of which voltages are set corresponding to the respective positive and negative data signals have a voltage difference lower than that between the conventional first and second voltages. Accordingly, it is possible to minimize a kick-back voltage.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
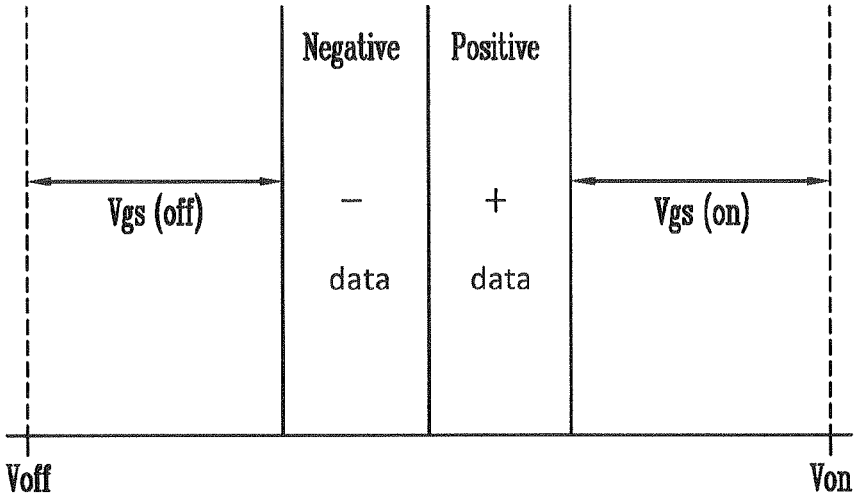
FIG. 1 is a view showing contemporary gate-on and gate-off voltages.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a view showing contemporary gate-on and gate-off voltages.

As shown in FIG. 1, a gate-on voltage Von is set so that the TFT can be turned on by the voltage of the positive (+) data signal, and a gate-off voltage Voff is set so that the TFT can be turned off by the voltage of the negative (−) data signal.

In this case, the gate-off voltage Voff significantly lower than that of the positive (+) data signal is applied, and the gate-on voltage Von significantly higher than that of the negative (−) data signal is applied. Therefore, power consumption is increased.

In a case where the voltage difference between the gate-on voltage Von and the gate-off voltage Voff is large, a kick-back voltage is generated as shown in FIG. 1, and therefore, the image quality is degraded.

Hereinafter, embodiments of the present invention will be described in detail with reference to the accompanying drawings.

Figure 2:
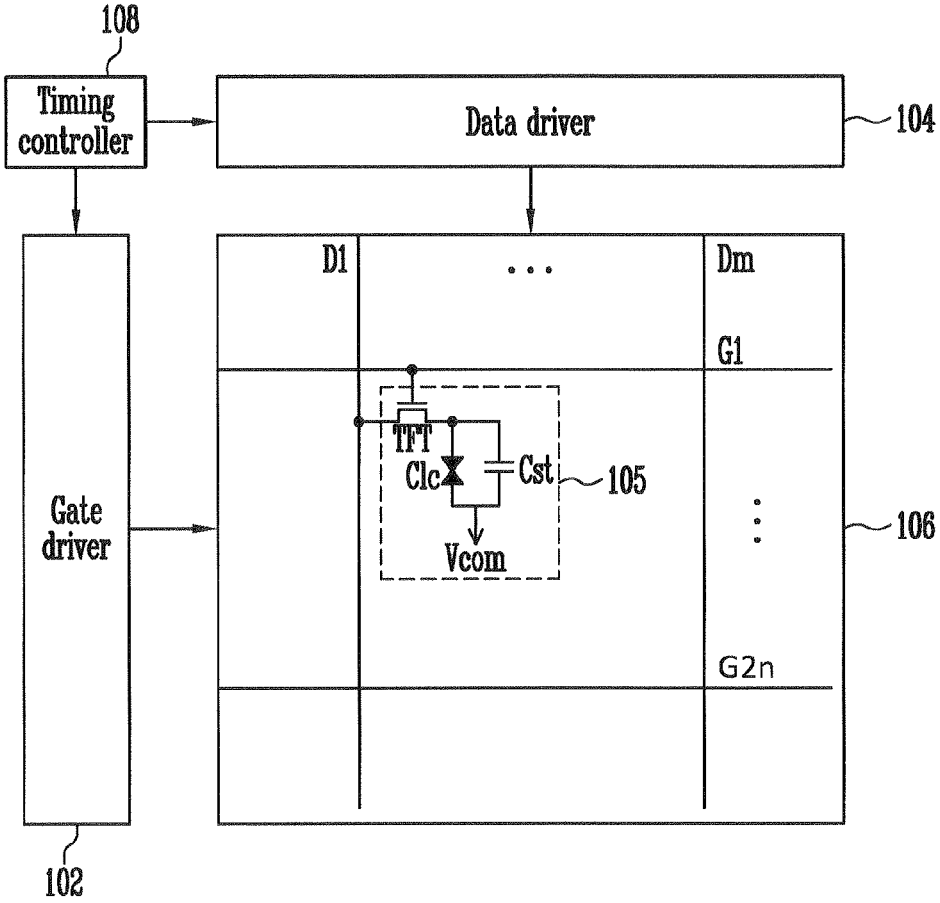
FIG. 2 is a view schematically showing a liquid crystal display device constructed with the principle of an embodiment of the present invention.

FIG. 2 is a view schematically showing a liquid crystal display device constructed with the principle of an embodiment of the present invention.

In reference to FIG. 2, the liquid crystal display device constructed with this embodiment of the present invention includes a gate driver 102, a data driver 104, a liquid crystal panel 105 including pixels 105 arranged in a matrix form, and a timing controller 108.

The pixels 105 are positioned at intersection portions of gate lines G1 to G2n and data lines D1 to Dm. Each pixel 105 includes a thin film transistor TFT, a liquid crystal cell Clc and a storage capacitor Cst.

The thin film transistor TFT supplies a data signal from a data line D to the liquid crystal cell Clc in response to a gate signal supplied to a gate line G. The liquid crystal cell Clc charges a pixel voltage corresponding to the difference between the voltage of the data signal and a common voltage Vcom, and controls liquid crystals so that light transmittance is adjusted corresponding to the pixel voltage. Here, liquid crystals between common and pixel electrodes are equivalently expressed as the liquid crystal cell Clc. The storage capacitor Cst maintains the pixel voltage during a predetermined period, e.g., during one frame period.

The gate driver 102 supplies a gate signal to the gate lines G1 to G2n. For example, the gate driver 102 may progressively supply the gate signal the gate lines G1 to G2n. Here, during a k-th (k is a natural number) frame period, the gate driver 102 supplies a first gate signal to odd-numbered gate lines G1, G3, . . . , G2n-1 and supplies a second gate signal set to a voltage different from that of the first gate signal to even-numbered gate lines G2, G4, . . . , G2n. During a (k+1)-th frame period, the gate driver 102 supplies the second gate signal to the odd-numbered gate lines G1, G3, . . . , G2n-1 and supplies the first gate signal to the odd-numbered gate lines G2, G4, . . . , G2n. This will be described in detail later.

The data driver 104 supplies a data signal to the data lines D1 to Dm in synchronization with a gate signal. Practically, the data driver 104 supplies a positive or negative data signal to the data lines D1 to Dm, corresponding to the gate signal. For example, the data driver 104 supplies a negative data signal to the data lines D1 to Dm in synchronization with the first gate signal, and supplies a positive data signal to the data lines D1 to Dm in synchronization with the second gate signal. This will be described in detail later.

The timing controller 108 controls the gate driver 102 and the data driver 104. To this end, the timing controller 108 may receive data, a vertical synchronization signal Vsync, a horizontal synchronization signal Hsync, a dot clock DCLK, a data enable (DE) signal, etc., which are not shown in this figure.

Figure 3:
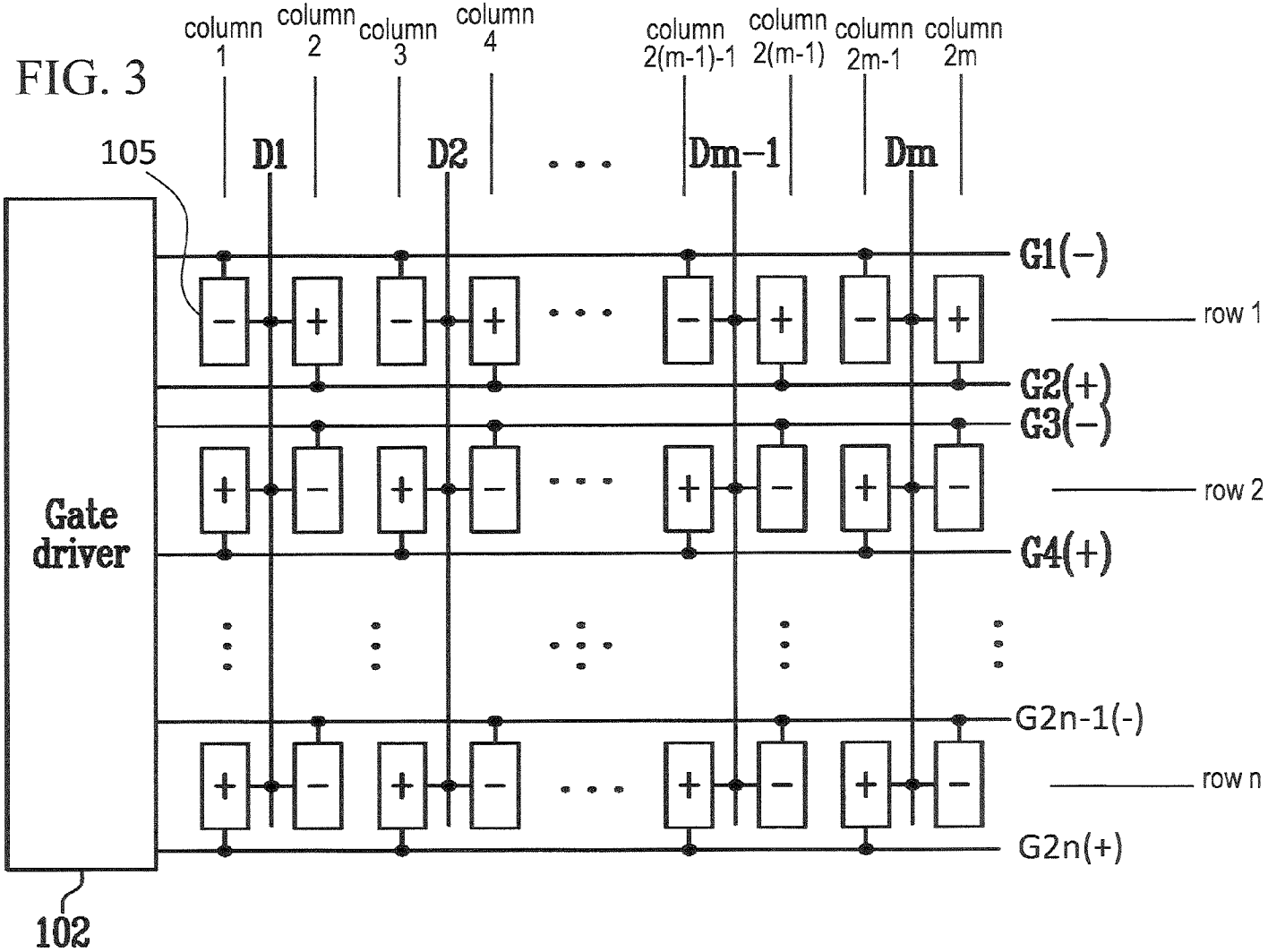
FIGS. 3 and 4 are views showing a connection structure of gate and data lines and pixels according to an embodiment of the present invention.
Figure 4:
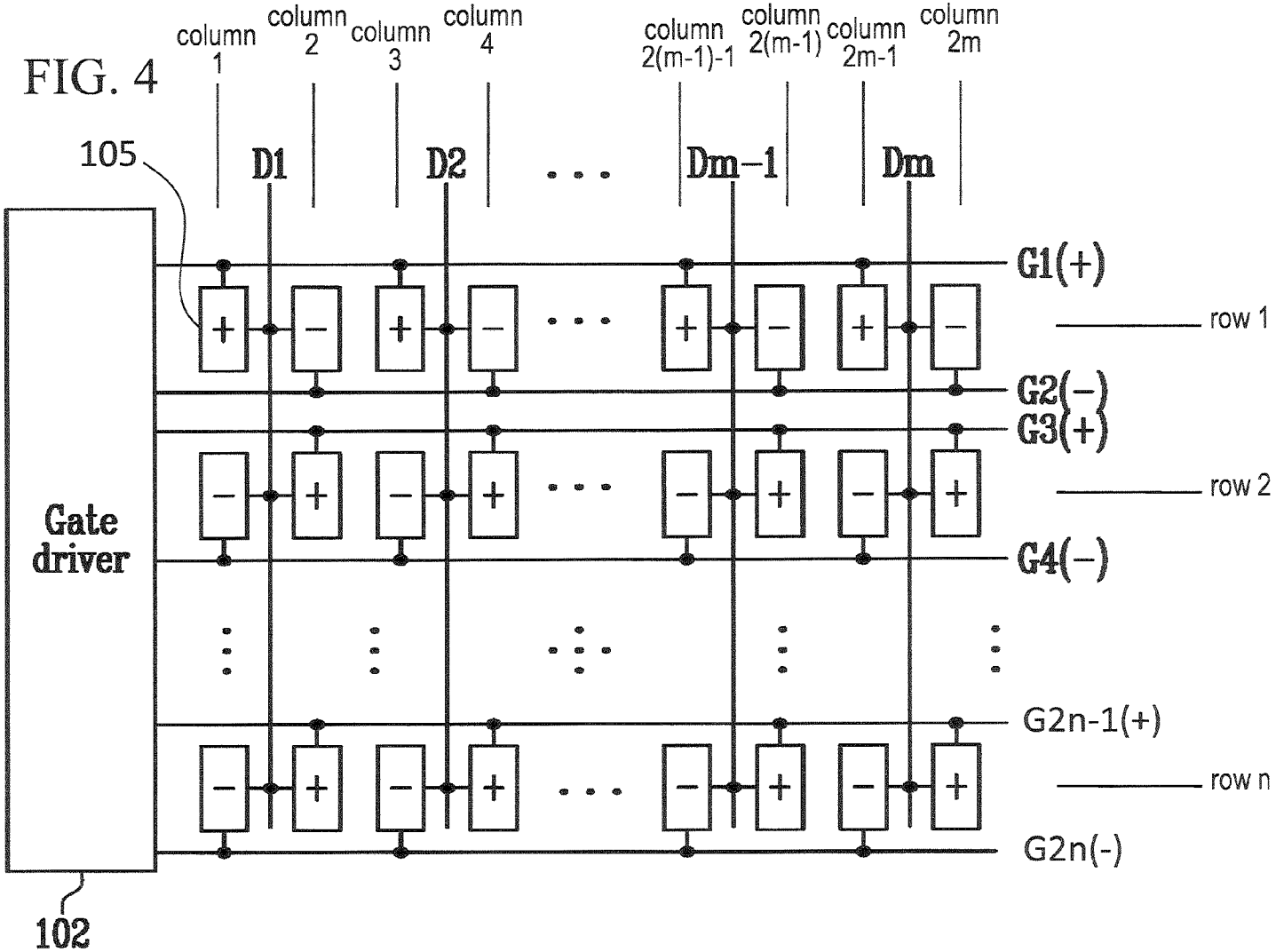

FIGS. 3 and 4 are views showing a connection structure of gate and data lines and pixels according to an embodiment of the present invention. For convenience of illustration, a case where the liquid crystal display device is driven using a dot inversion driving method is shown in FIG. 3.

Pixels are disposed in a matrix of n rows and 2m columns. Odd-numbered column of pixels and even-numbered column of pixels are alternately disposed, and odd-numbered row of pixels and even-numbered row of pixels are alternately disposed.

Data lines D1-Dm are disposed in parallel with each other and with the columns of pixels, and each data line is sandwiched between two adjacent columns of pixels. For example, data line D2 is sandwiched between column 3 of pixel and column 4 of pixels. Odd-numbered data lines (D1, D3, . . . ) and even-numbered data lines (D2, D4, . . . ) are alternately disposed.

Gate lines G1-G2n are disposed in parallel with each other and with the rows of pixels. Odd-numbered gate lines (G1, G3, . . . , G2n-1) and even-numbered gate lines (G2, G4, . . . , G2n) are alternately disposed. One row of pixels corresponds to one odd-numbered gate line and one even-numbered gate line. For example, row 2 of pixels corresponds to gate lines G3 and G4.

In reference to FIG. 3, in the liquid crystal display device according to this embodiment, two gate lines are formed every horizontal line, and the two gate lines are alternately coupled to different pixels 105.

Here, an i-th (i is an odd number) gate line Gi positioned on an i-th horizontal line is coupled to pixels 105 positioned on an i-th vertical line, and an (i+1)-th gate line Gi+1 positioned on the i-th horizontal line is coupled to pixels 105 positioned on an (i+1)-th vertical line. An i-th gate line Gi positioned on an (i+1)-th horizontal line is coupled to pixels 105 positioned on an (i+1)-th vertical line, and an (i+1)-th gate line Gi+1 is coupled pixels 105 positioned on an i-th vertical line.

More specifically, an odd-numbered gate line corresponding to an odd-numbered row of pixels is coupled to pixels positioned in odd-numbered columns of pixels, and an even-numbered gate line corresponding to the odd-numbered row of pixels is coupled to pixels positioned in even-numbered columns of pixels. For example, gate line G1 corresponding row 1 of pixels is coupled to pixels positioned in odd-numbered columns of pixels, and gate line G2 corresponding to row 1 of pixels is coupled to pixels positioned in even-numbered columns of pixels.

An odd-numbered gate line corresponding to an even-numbered row of pixels is coupled to pixels positioned in even-numbered columns of pixels, and an even-numbered gate line corresponding to the even-numbered row of pixels is coupled to pixels positioned in odd-numbered columns of pixels. For example, gate line G3 corresponding to row 2 of pixels is coupled to pixels positioned in even-numbered columns of pixels, and gate line G4 corresponding to row 2 of pixels is coupled to pixels positioned in odd-numbered columns of pixels.

Each of the data lines D1 to Dm is coupled to two adjacent pixels 105 every horizontal line. For example, a first data line D1 is coupled to pixels 105 positioned on first and second horizontal lines, and a second data line D2 is coupled to pixels 105 positioned on third and fourth horizontal lines.

The operation process of the liquid crystal display device will be schematically described. The gate driver 102 progressively supplies a gate signal to the gate lines G1 to G2n, and the data driver 104 supplies a data signal in synchronization with the gate signal.

When the gate signal is supplied to the odd-numbered gate lines G1, G3, . . . during the k-th frame period, the data driver 104 supplies a negative (−) data signal as shown in FIG. 3. When the gate signal is supplied to the even-numbered gate lines G2, G4, . . . , the data driver 104 supplies a positive (+) data signal. Subsequently, when the gate signal is supplied to the odd-numbered gate lines G1, G3, . . . during the (k+1)-th frame period, the data driver 104 supplies the positive (+) data signal as shown in FIG. 4. When the gate signal is supplied to the even-numbered lines G1, G3, . . . , the data driver 104 supplies the negative (−) data signal.

That is, in the present invention, a data signal having the same polarity (negative or positive) is supplied, corresponding to the gate signal supplied to the odd-numbered gate lines G1, G3, . . . , during the same frame period. Similarly, a data signal having the same polarity (positive or negative) is supplied, corresponding to the gate signal supplied to the even-numbered gate lines G2, G4, . . . , during the same frame period. Thus, in the present invention, the voltage of the gate signal can be controlled, corresponding to the positive or negative data signal.

Practically, during the k-th frame period, the gate driver 102 supplies the first gate signal to the odd-numbered gate lines G1, G3, . . . , corresponding to the negative data signal, and supplies the second gate signal to the even-numbered gate lines G2, G4, . . . , corresponding to the positive data signal. During the (k+1)-th frame period, the gate driver 102 supplies the second gate signal to the odd-numbered gate lines G1, G3, . . . , corresponding to the positive data signal, and supplies the first gate signal to the even-numbered gate lines G2, G4, . . . , corresponding to the negative data signal.

Figure 5:
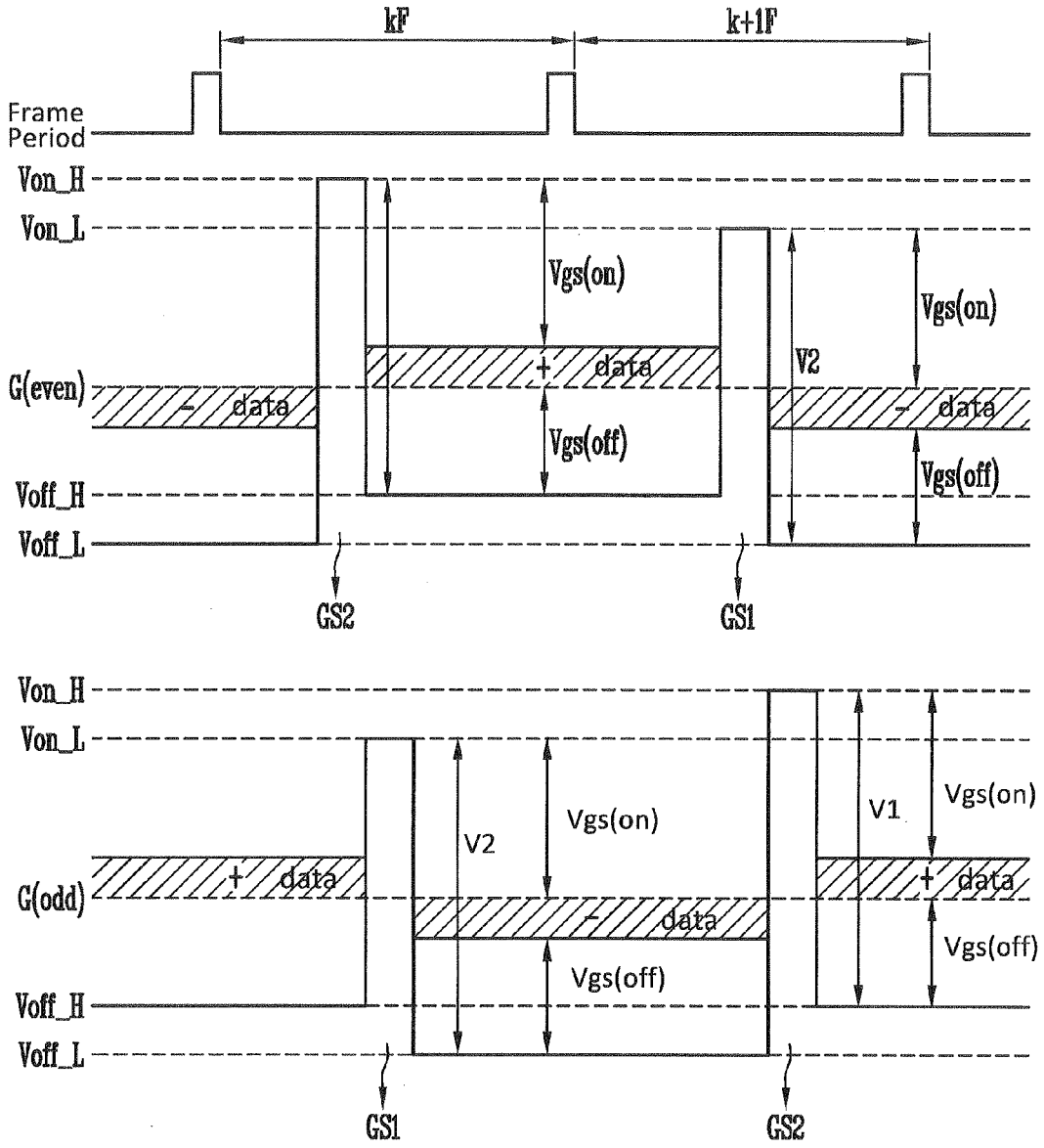
FIGS. 5 and 6 are voltage waveforms of first and second gate signals according to an embodiment of the present invention.
Figure 6:
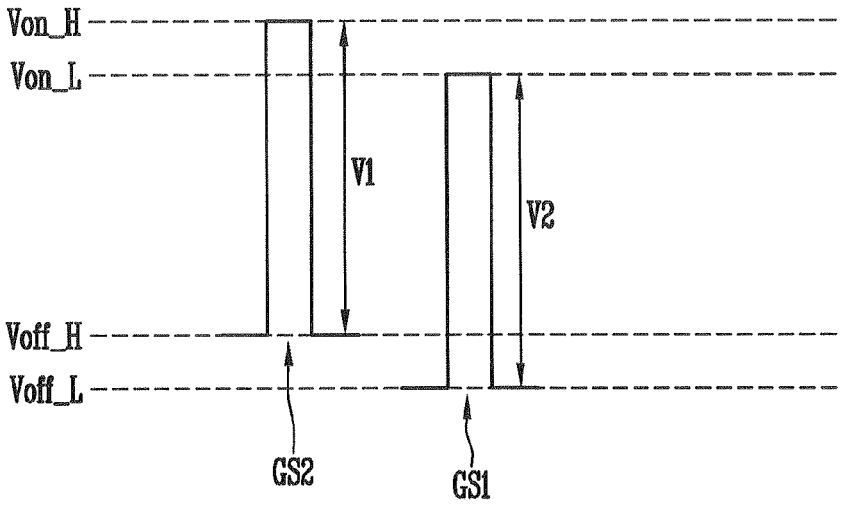

FIGS. 5 and 6 are views showing embodiments of first and second gate signals. For convenience of illustration, one odd-numbered gate line G(odd) and one even-numbered gate line G(even) are shown in FIG. 5.

In reference to FIG. 5, a negative (−) data signal is supplied to pixels coupled to an odd-numbered gate line G(odd) during the k-th frame period. Therefore, a first gate signal GS1 corresponding to the negative (−) data signal is supplied to the odd-numbered gate line G(odd) during the k-th frame period. The first gate signal GS1 is set to a first gate-on voltage Von_L and a first gate-off voltage Voff_L, corresponding to the negative (−) data signal.

A positive (+) data signal is supplied to pixels coupled to an even gate line G(even) during the k-th frame period. Therefore, a second gate signal GS2 corresponding to the positive (+) data signal is supplied to the even-numbered gate line G(even) during the k-th frame period. The second gate signal GS2 is set to a second gate-on voltage Von_H and a second gate-off voltage Voff_H, corresponding to the positive (+) data signal.

Here, the second gate-on voltage Von_H set corresponding to the positive (+) data signal is set to a voltage higher than the first gate-on voltage Von_L set corresponding to the negative (−) data signal. The first gate-off voltage Voff_L set corresponding to the negative (−) gate signal is set to a voltage lower than the second gate-off voltage Voff_H set corresponding to the positive (+) data signal.

Meanwhile, the voltage difference between the first gate-on voltage Von_L and the first gate-off voltage Voff_L is set to a second voltage V2, and the voltage difference between the second gate-on voltage Von_H and the second gate-off voltage Voff_H is set to a first voltage V1. Here, the first and second voltages V1 and V2 are set identical to each other in order to ensure stable driving of the transistor TFT.

As described above, in the present invention, the first gate signal is supplied corresponding to the negative data signal, and the second gate signal is supplied corresponding to the positive data signal. In this case, the voltage of the gate signal can be set corresponding to each of the positive and negative data signals, thereby reducing power consumption. Further, in the present invention, the gate-on voltage and the gate-off voltage can be respectively set corresponding to the positive and negative data signals, and accordingly, it is possible to minimize the voltage difference between the gate-on voltage and the gate-off voltage. Thus, in the present invention, it is possible to minimize a kick-back voltage generated in proportion to the voltage difference between the gate-on voltage and the gate-off voltage.

Figure 7:
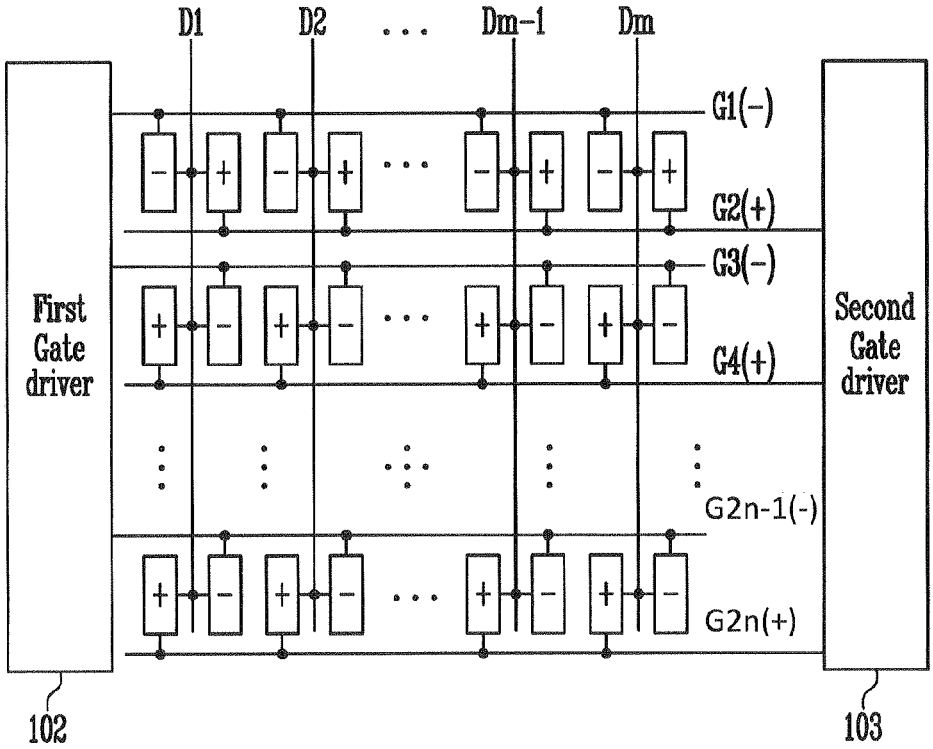
FIG. 7 is a view showing the connection structure of the gate and data lines and the pixels according to another embodiment of the present invention.

FIG. 7 is a view showing another embodiment of the connection structure of the gate and data lines and the pixels. In FIG. 7, detailed descriptions of components identical to those of FIG. 3 will be omitted.

Referring to FIG. 7, the liquid crystal display device according to this embodiment includes a first gate driver 102 for driving odd-numbered gate lines G1, G3, . . . , and a second gate driver 103 for driving even-numbered gate lines G2, G4, . . . .

The first gate driver 102 progressively supplies the first or second gate signal to the odd-numbered gate lines G1, G3, . . . , corresponding to the polarity of the data signal, every frame. The second gate driver 102 progressively supplies the second or first gate signal to the even-numbered gate lines G2, G4, . . . , corresponding to the polarity of the data signal, every frame.

That is, in this embodiment, the operation process of the liquid crystal display device is substantially identical to that of the aforementioned embodiment, except that the two gate drivers 102 and 103 are provided to separately drive the odd-numbered gate lines G1, G3, . . . and the even-numbered gate lines G2, G4, . . . .

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A liquid crystal display device, comprising:

pixels positioned at intersection portions of gate lines and data lines;

a data driver that supplies a data signal having a first or second polarity to the data lines; and at least one gate driver that supplies, to the gate lines, a first gate signal corresponding to the first polarity and a second gate signal corresponding to the second polarity, wherein the first polarity is set to be negative and the second polarity is set to be positive, wherein the first gate signal is set to a first gate-on voltage and a first gate-off voltage, and the second gate signal is set to a second gate-on voltage higher than the first gate-on voltage and a second gate-off voltage higher than the first gate-off voltage, and wherein a second voltage difference between the first gate-on voltage and the first gate-off voltage is set identical to a first voltage difference between the second gate-on voltage and the second gate-off voltage.

2. The liquid crystal display device of claim 1, wherein the first and second gate signals are set to gate-on and gate-off voltages different from each other.

3. The liquid crystal display device of claim 1, wherein the pixels are disposed in a matrix of columns and rows, one odd-numbered gate line and one even-numbered gate line correspond to one row of pixels, an odd-numbered gate line corresponding to an odd-numbered row of pixels is coupled to pixels positioned in odd-numbered columns of pixels, and an even-numbered gate line corresponding to the odd-numbered row of pixels is coupled to pixels positioned in even-numbered columns of pixels.

4. The liquid crystal display device of claim 3, wherein an odd-numbered gate line corresponding to an even-numbered row of pixels is coupled to pixels positioned in even-numbered columns of pixels, and an even-numbered gate line corresponding to the even-numbered row of pixels is coupled to pixels positioned in odd-numbered columns of pixels.

5. The liquid crystal display device of claim 3, wherein the odd-numbered gate line and the even-numbered gate line are driven by one gate driver.

6. The liquid crystal display device of claim 3, wherein the odd-numbered gate line is driven by a first gate driver, and the even-numbered gate line is driven by a second driver different from the first gate driver.

7. The liquid crystal display device of claim 1, wherein each data line is coupled to two adjacent columns of pixels.

8. A driving method of a liquid crystal display device, comprising:

supplying a first gate signal to odd-numbered gate lines, corresponding to a data signal having a first polarity, during a k-th (k is a natural number) frame period; and supplying a second gate signal set to a voltage different from the first gate signal to even-numbered gate lines, corresponding to a data signal having a second polarity, during the k-th frame period, wherein the second gate signal is supplied to the odd-numbered gate lines, corresponding to the data signal having the second polarity, during a (k+1)-th frame period, and the first gate signal is supplied to the even-numbered gate lines, corresponding to the data signal having the first polarity, during the (k+1)-th frame period.

9. The driving method of claim 8, wherein the first polarity is set to be negative and the second polarity is set to be positive.

10. The driving method of claim 9, wherein the first gate signal is set to a first gate-on voltage and a first gate-off voltage, and the second gate signal is set to a second gate-on voltage higher than the first gate-on voltage and a second gate-off voltage higher than the first gate-off voltage.

11. The driving method of claim 10, wherein a second voltage difference between the first gate-on voltage and the first gate-off voltage is set identical to a first voltage difference between the second gate-on voltage and the second gate-off voltage.

* * * * *